US008505901B2

(12) United States Patent
Tsuno

(10) Patent No.: US 8,505,901 B2
(45) Date of Patent: Aug. 13, 2013

(54) SHEET POST-PROCESSING APPARATUS AND IMAGE FORMING APPARATUS

(75) Inventor: Akihiro Tsuno, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 79 days.

(21) Appl. No.: 13/137,720

(22) Filed: Sep. 7, 2011

(65) Prior Publication Data

US 2012/0065044 A1 Mar. 15, 2012

(30) Foreign Application Priority Data

Sep. 9, 2010 (JP) ..... 2010-201850
Jun. 30, 2011 (JP) ..... 2011-145945

(51) Int. Cl.
*B31F 1/08* (2006.01)

(52) U.S. Cl.
USPC ..... 270/45; 270/32

(58) Field of Classification Search
USPC ..... 270/32, 37, 45; 493/254, 356, 416, 493/419, 427, 434, 436, 437, 442, 444, 445
See application file for complete search history.

(56) References Cited

U.S. PATENT DOCUMENTS 4,190,243 A * 2/1980 Michalik et al. ..... 493/356
6,354,059 B1 * 3/2002 Yoshie et al. ..... 53/117
6,575,447 B2 * 6/2003 Yoshie et al. ..... 270/58.07
7,562,866 B2 * 7/2009 Hayashi ..... 270/58.07
7,744,076 B2 6/2010 Suzuki et al.
8,191,882 B2 * 6/2012 Kikkawa et al. ..... 270/45
2008/0284092 A1 11/2008 Suzuki et al.
2009/0258774 A1 10/2009 Suzuki et al.
2010/0148417 A1 6/2010 Suzuki et al.
2010/0239393 A1 9/2010 Suzuki et al.
2010/0258994 A1 * 10/2010 Kikkawa et al. ..... 270/37
2010/0295231 A1 * 11/2010 Igata ..... 270/58.12
2011/0103921 A1 5/2011 Suzuki et al.
2011/0229287 A1 9/2011 Suzuki
2011/0301009 A1 12/2011 Hattori et al.

FOREIGN PATENT DOCUMENTS

EP 2 392 530 12/2011
JP 2003-182928 7/2003
JP 3918545 B2 7/2003
JP 4044461 B2 9/2004
JP 2007-237562 9/2007
JP 20106602 A 1/2010

OTHER PUBLICATIONS

Abstract of JP 2004-262625 published Sep. 24, 2004.
Abstract of JP 2003-182928 published Jul. 3, 2003.
Abstract of JP 2010-006602 published Jan. 14, 2010.
European Search Report dated Dec. 29, 2011.

* cited by examiner

*Primary Examiner* — Leslie A Nicholson, III
(74) *Attorney, Agent, or Firm* — Harness, Dickey & Pierce, P.L.C.

(57) ABSTRACT

A sheet post-processing apparatus includes: an accumulating unit accumulating a sheet having been conveyed; a center-folding unit folding a central portion, in a conveying direction in which the sheet is conveyed, of the sheet, which has been accumulated by the accumulating unit, and a pressing force moving unit that applies a pressing force to the sheet, which has been folded by the center-folding unit, and moves a portion, at which the pressing force is applied, on the sheet in the conveying direction.

10 Claims, 13 Drawing Sheets

SHEET POST-PROCESSING APPARATUS AND IMAGE FORMING APPARATUS

CROSS-REFERENCE TO RELATED APPLICATIONS

The present application claims priority to and incorporates by reference the entire contents of Japanese Patent Application No. 2010-201850 filed in Japan on Sep. 9, 2010 and Japanese Patent Application No. 2011-145945 filed in Japan on Jun. 30, 2011.

BACKGROUND OF THE INVENTION

1. Field of the Invention

The present invention relates to a sheet post-processing apparatus performing post-processing such as sorting and stapling and an image forming apparatus including the sheet post-processing apparatus.

2. Description of the Related Art

As a method of reducing a height of folded part in saddle stitching and center-folding in a sheet post-processing apparatus performing post-processing such as sorting and stapling, there is known, as disclosed in Japanese Patent Application Laid-open No. 2003-182928, a mechanism of housing sheets discharged from an image forming apparatus in an accumulating unit and center-folding a saddle stitched sheet bundle, the mechanism having a configuration in which a folding plate presses a central portion of the saddle-stitched sheet bundle in the conveying direction to push the central portion into a nip of a pair of first folding rollers to form a folded portion in the sheet bundle; the center-folded sheet bundle is stopped at a predetermined position; and subsequently, a second folding roller movable in a direction orthogonal to the sheet conveying direction runs on the folded portion while pressing the folded portion to increase intensity of folding.

As disclosed in Japanese Patent Application Laid-open No. 2010-006602, there is known a mechanism includes a pressing unit that is provided downstream of a folding unit folding a stitched sheet bundle in two and sandwiches a folded portion of the stitched sheet bundle, which has been folded in two, from a front and a back between press surfaces opposing each other to apply pressing pressure thereto, and a pressing count control unit setting the pressing count and controlling pressing operation, so that continuous pressurization can be performed when the pressing pressure is applied, and this pressing can be performed a plurality of times; as a result, even when the sheet bundle includes a great number of sheets, intensity of folding can be reliably increased by performing pressing an appropriately number of times depending on the number of sheets.

The conventional arts described above, for example, the configuration disclosed in Japanese Patent Application Laid-open No. 2003-182928 makes the second folding roller move in the direction orthogonal to the conveying direction relative to the folded portion after the sheet bundle is folded in two. Therefore, the structure disadvantageously becomes complex, is upsized and high-priced.

The mechanism of Japanese Patent Application Laid-open No. 2010-006602 is a mechanism of applying pressure to the sheet bundle it with the press from above and below after the sheet bundle is folded in two, and therefore, the machine is also disadvantageously upsized and high-priced. Also in increase of intensity of folding, pressing pressure is applied all over the sheet bundle folded in two and thus is dispersed to require longer pressing time and an increase number of times of pressing, which disadvantageously reduce the productivity.

SUMMARY OF THE INVENTION

It is an object of the present invention to at least partially solve the problems in the conventional technology.

According to an aspect of the present invention, there is provided a sheet post-processing apparatus including: an accumulating unit accumulating a sheet having been conveyed; a center-folding unit folding a central portion, in a conveying direction in which the sheet is conveyed, of the sheet, which has been accumulated by the accumulating unit, and a pressing force moving unit that applies a pressing force to the sheet, which has been folded by the center-folding unit, and moves a portion, at which the pressing force is applied, on the sheet in the conveying direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is viewed from a different angle;

FIG. 10 is viewed from a side;

DETAILED DESCRIPTION OF THE PREFERRED EMBODIMENTS

A sheet post-processing apparatus according to an embodiment of the present invention has a configuration in which a pressing unit is provided downstream of a folding blade used to perform a saddle stitching process or a center-folding process on a introduced sheet with an image formed thereon so that a central portion of the sheet in a width direction can be pressed. The sheet can be pressed uniformly across the whole width by pressing the central portion in the sheet width direction, and thus, the height of the folded portion can be reduced.

The sheet post-processing apparatus also includes a pressure transmitting member and a pressure moving member, with which pressing pressure can be moved in a conveying direction, so that pressing pressure can be intensively applied to the folded portion of a sheet bundle, thereby reducing the height of the folded portion of the sheet bundle with a low-cost configuration to improve qualities of saddle stitching and center-folding.

Pressing pressure is uniformly applied across a direction orthogonal to the conveying direction by arranging a plurality of pressure transmitting members in the direction orthogonal to the conveying direction. The pressure transmitting member may be made slidable. The pressing pressure moving member may include a rotator. The pressing pressure moving member may includes a pair of rotators to have durability to reduce the height of the folded portion of the sheet bundle with a further low-cost configuration to improve qualities of saddle stitching and folding. The pressing pressure moving member can include bearing members at both ends. Moreover, the folding blade may be curved to intensively apply the pressing pressure to the folded portion by curving.

Embodiments according to the present invention are described below with reference to the accompanying drawings.

Figure 1:
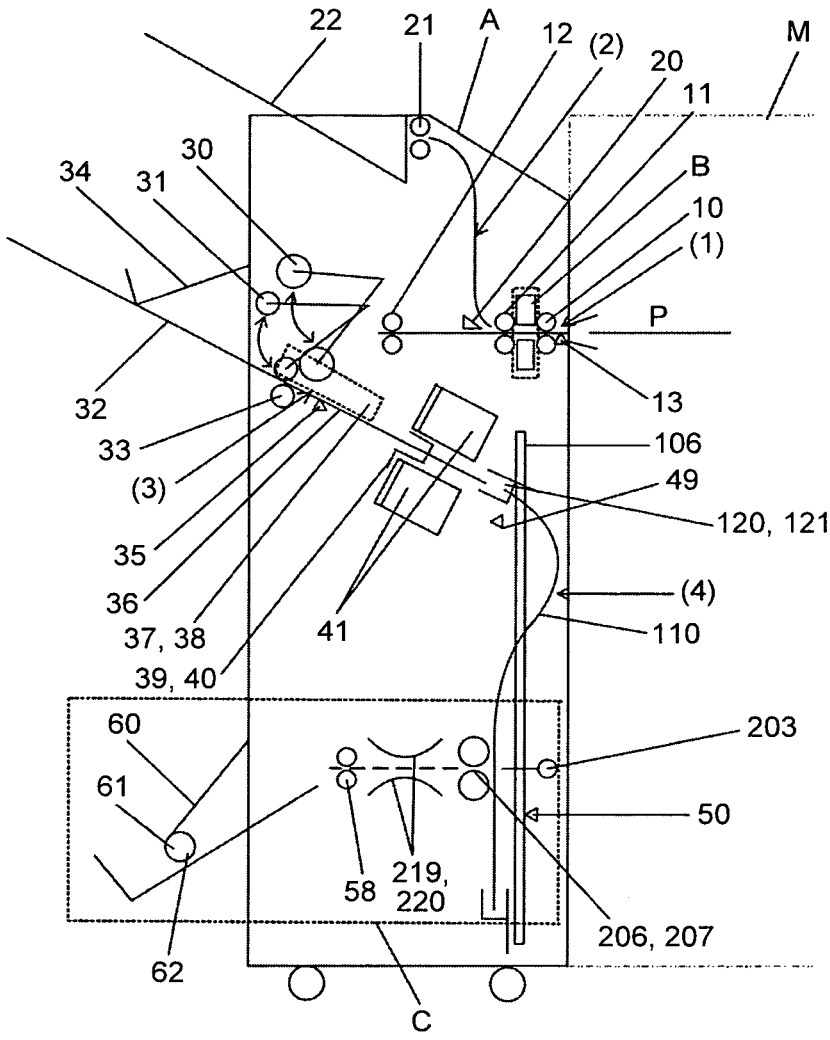
FIG. 1 is a schematic illustrating a sheet post-processing apparatus A according to an embodiment of the present invention.

A sequence of actions performed by the whole machine when pressure is applied in a direction orthogonal to the conveying direction will be described. FIG. 1 is a schematic of a sheet post-processing apparatus A according to an embodiment of the present invention. The sheet post-processing apparatus includes: an introducing path 1 used to receive a sheet P with an image formed thereon that is discharged from an image forming apparatus M not illustrated in detail (which may include various image forming apparatuses such as copying machines, printers, or multifunction peripherals (MFPs) including at least two functions of copying, faxing, printing, etc.); a conveying path 2 used to stack the sheet P on a discharge tray 22; a conveying path 3 used to intermediately stack the sheet P; and a conveying path 4 used to convey a sheet bundle, having a central portion in the sheet length having been saddle stitched in the conveying path 3, to a paper folding unit.

The vicinity of a sheet entrance will be described. Entrance rollers 10 and an entrance sensor 13 are arranged at the conveying path 1 and it is detected that the sheet P is fed into the sheet post-processing apparatus A. A sheet perforating unit B is arranged downstream of the entrance rollers 10 in the sheet conveying direction, and conveying rollers 11 and 12 are arranged downstream of the sheet perforating unit B. The sheet P is conveyed to the conveying path 3 through the rollers 11 and 12.

Proof discharging will be described. The conveying path 2 is a path used to convey the sheet P to the discharge tray 22. The sheet P whose traveling direction is changed by a branching claw 20 from the conveying path 1 is conveyed by discharging rollers 21 to the discharge tray 22.

Shifting and stacking actions will be described. Discharging rollers 31 and 33 and a discharging sensor 35 are arranged in the conveying path 3. In a sorting mode, the conveying rollers 12 having a shifting mechanism are moved in a direction orthogonal to the conveying direction by a driving unit (not illustrated) by a certain amount during conveying to shift the sheet P by the certain amount and the sheet P is discharged by the discharging roller 33 to a discharge tray 32 to sequentially stack that sheet P. A discharge outlet to the discharge tray 32 has a structure in which the sheet or sheet bundle are nipped and held between the discharging roller 33 and the driven roller 31 to discharge that sheet or sheet bundle. In this structure, the driven roller 31 can move to come in contact with and to be separated from the discharging roller 33 to selectively take a closed state where they nipping and holding the sheet or the sheet bundle to discharge or an opened state where they do not nip or hold the sheet or the sheet bundle. After the shifting action of the sheet is completed, the sheet is nipped and held to be discharged.

The vertical action of a shift tray will be described. A feeler 34 is provided near and above a discharging port and is arranged to be rotatable to a position near the center of the stacked sheet P, and an end of the feeler 34 comes in contact with an upper surface of the sheet P. An upper surface detecting sensor (not illustrated) detecting a height position of the end of the feeler 34 is provided near a base of the feeler 34. A paper surface height of the stacked sheet P is detected by these elements. When the upper surface detecting sensor is turned ON as the height of the sheets stacked on the discharge tray 32 increases due to increase in number of that sheets, a control unit (not illustrated) controls a driving unit (not illustrated), which serves to move the discharge tray 32 up and down, to lower the discharge tray 32. When the discharge tray 32 lowers and the upper surface detecting sensor not illustrated is turned OFF, lowering of the discharge tray 32 is stopped. After this action is repeated until the discharge tray 32 reaches a specified tray filling level, the sheet post-processing apparatus A outputs a stop signal to the image forming apparatus to stop an image forming action in the system.

A stapling action is performed in the following manner. A tray 36 and a tapping roller 30 are arranged in the conveying path 3, and a stapler 41, which is divided into a driver and a clincher that move in a direction orthogonal to the surface of FIG. 1, is arranged at an end position of the conveying path 3. Jogger fences 37 and 38 are further included that move in a direction orthogonal to the surface of FIG. 1 to align sheets on the stapler tray 36. The sheets conveyed in the conveying path 3 are discharged onto the stapler tray 36 and are aligned in a width direction by the jogger fences 37 and 38. The tapping roller 30 comes in contact with the upper surface of the sheets by the pendulum motion to make the sheets switch back toward the stapler 41 to make the trailing edges of the sheets abut reference fences 39 and 40 to align the sheet bundle in the longitudinal direction. In an edge stitching mode, the stapler 41 moves in a direction orthogonal to the surface of FIG. 1 and staples thus aligned sheet bundle at proper positions of a lower edge of the sheet bundle to stitch that lower edge, and the sheet bundle is nipped and held between the discharging rollers 31 and 33 to discharge the sheet bundle onto the discharge tray 32.

A saddle stitching mode is described with reference to FIG. 1. When the saddle stitching mode is selected, the reference fences 39 and 40 are moved outside of the sheet width so as not to disturb sheet bundle conveyance. Clamp movable fences 120 and 121 move to an aligning position at which the clamp movable fences 120 and 121 aligns the edges of such sheets P. Subsequently, the sheets P conveyed from the image forming apparatus M are sequentially conveyed onto the tray 36 by the roller 12, and the edges of the sheets M abut the clamp movable fences 120 and 121, thereby aligning the edges the sheets M. The aligned sheet bundle is clamped and held by the clamp movable fences 120 and 121 and is moved to a saddle stitching position depending on size of the sheets P using a clamp movable fence home positioning sensor 49 as a reference. The stapler 41 saddle stitches the central portion of the sheet bundle in the sheet conveying direction.

The saddle stitched sheet bundle is clamped and held by the clamp movable fences 120 and 121 and is conveyed to a folding unit C along the conveying path 4. At this time, a mechanism of moving the clamp movable fences 120 and 121 is installed in a clamp vertical shaft 106 arranged outside of a machine side plate, and moves in a vertical direction and in a horizontal direction along the curved conveying path 4. The clamp movable fences 120 and 121 are moved in the vertical direction along the clamp vertical shaft 106 and are moved in the horizontal direction along a guiding rail 110 that has the same path with the conveying path 4 and that is provided at the machine side plate to convey the sheet or the sheet bundle along the conveying path 4.

A press folding unit will be described. The saddle stitched sheet or sheet bundle is conveyed further downwardly by the clamp movable fences 120 and 121 and is stopped at a position where the center in the sheet size length is located at a folding blade 203, and process goes to a folding process. The stop position is a position when a number of pulses predetermined depending on the sheet size are transmitted after a folding position sensor 50 detects the trailing edge of the sheet. The central portion in the sheet bundle length stopped at the folding position is introduced into the press folding unit by the folding blade 203 and conveying rollers 206 and 207. The introduced central portion in the sheet bundle length is pressed from above and below with pressing plates 219 and 220 to fold that central portion. The center-folded sheet or sheet bundle is discharged onto a saddle stitch tray 62 by the conveying rollers 206 and 207 and discharging rollers 58. The illustrated example indicates only an example employing the so-called folding blade but the present invention is not limited to this, and can employ various folding units such as a folding edge.

The sheet or sheet bundle discharged onto the saddle stitch tray 62 is pressed with a sheet pressing roller 61 installed in a sheet pressing unit 60 to prevent the folded sheets from being expanded and disturbing the discharge of a sheet discharged next. The sheet perforating unit B and the folding unit C having the conveying path 4 are configured to be detachable to allow the provision of various types of sheet post-processing apparatuses depending on user needs.

A clamp bundle conveying unit will be described.

Figure 2:
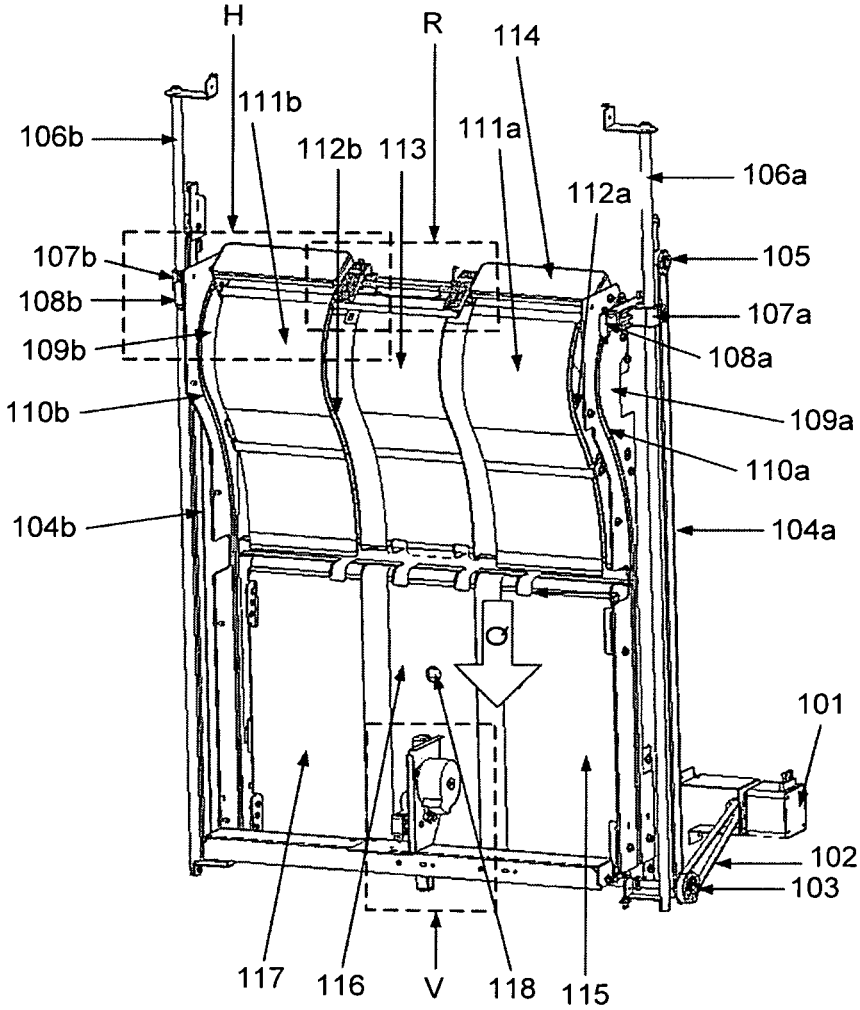
FIG. 2 is an overall view of a clamp bundle conveying unit.

FIG. 2 is an overall view of the clamp bundle conveying unit. In the clamp bundle conveying unit, rotational motion of a clamp moving motor 101 is transmitted via a driving belt 102, thereby being converted to upward and downward motion by a vertical conveying belt 104*a* stretched around a lower vertical driving pulley 103 and an upper vertical driving pulley 105 and a vertical conveying belt 104*b* stretched at an opposite side. Clamp vertical movement components 107*a* and 107*b* are fixed to the vertical conveying belts 104*b* and 104*a*, and are supported to be movable in the vertical direction with shafts 106*a* and 106*b*. Clamp horizontal movement components 108*a* and 108*b* are attached to the clamp vertical movement components 107*a* and 107*b* to enable the movement in the horizontal direction. The clamp horizontal movement components 108*a* and 108*b* are connected to a clamp stay 114 that is a metal plate. This clamp stay 114 moves in an arrow Q direction of FIG. 2 along rails 110*a* and 110*b* of side plates 109*a* and 109*b* in conjunction with the upward and downward motion of the vertical conveying belts 104*a* and 104*b*.

At this time, the sheet or sheet bundle having a trailing edge clamped and held by a clamp unit R is conveyed through a conveying path defined by feed guiding plates 111*a*, 111*b*, 112*a*, 112*b*, 113, 115, 116, and 117. The sheet or sheet bundle is detected by a folding position sensor 118 and the conveyance is stopped at a predetermined position.

Figure 3:
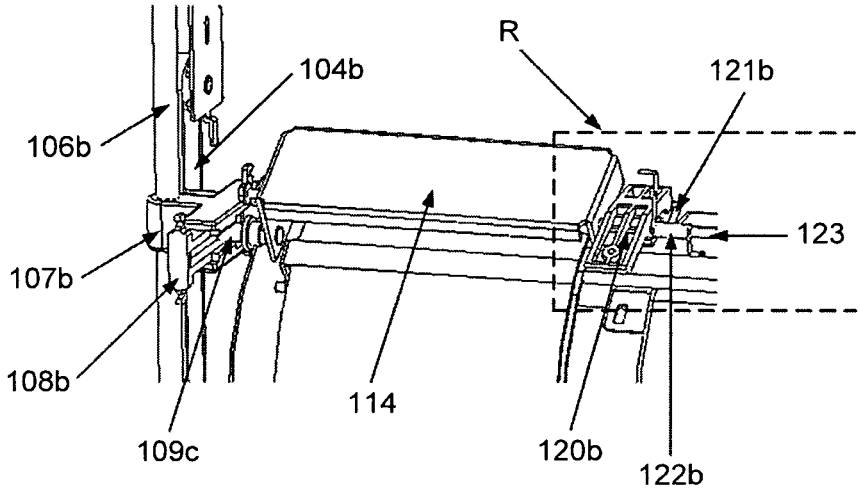
FIG. 3 is an enlarged view of dotted lined part (H) illustrated in FIG. 2.

FIG. 3 that is an enlarged view of dotted lined portion (H) illustrated in FIG. 2 will be described.

As illustrated in FIG. 3, the clamp horizontal movement components 108*a* and 108*b* are slidably arranged in the clamp vertical movement components 107*a* and 107*b*, and a clamp stay shaft 109*c* (one side is illustrated but a similar structure is provided at a side opposite to the dotted lined portion (H)) is inserted therein. Thus, the clamp stay 114 is movable also in the horizontal direction along the rails 110*a* and 110*b* of the side plates 109*a* and 109*b* while moving upwardly and downwardly. For the clamp stay 114, upper clamps 120*a* and 120*b* are provided so as to be pressed by springs 122*a* and 122*b* toward lower clamps 121*a* and 121*b*, which are fixed, around a clamp shaft 123 as a rotational center.

Figure 4:
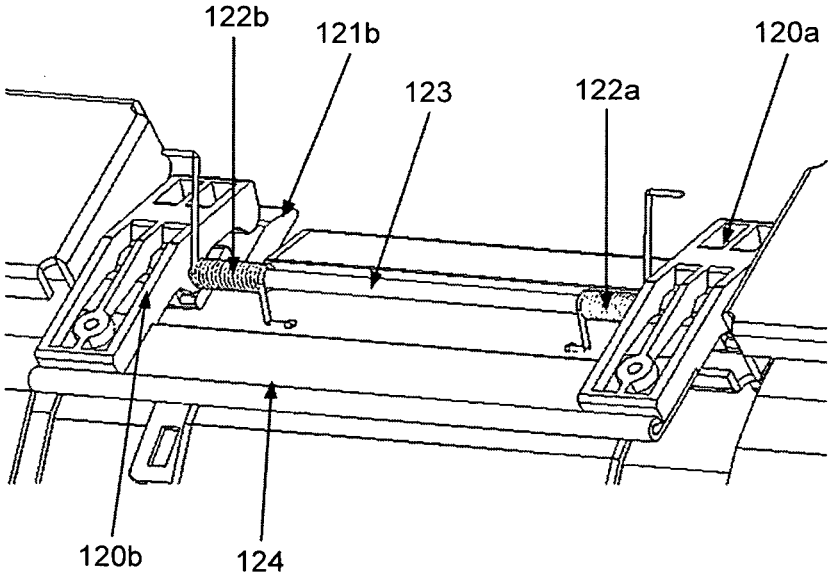
FIG. 4 is an enlarged view of dotted lined part (R) illustrated in FIGS. 2 and 3.
Figure 5:
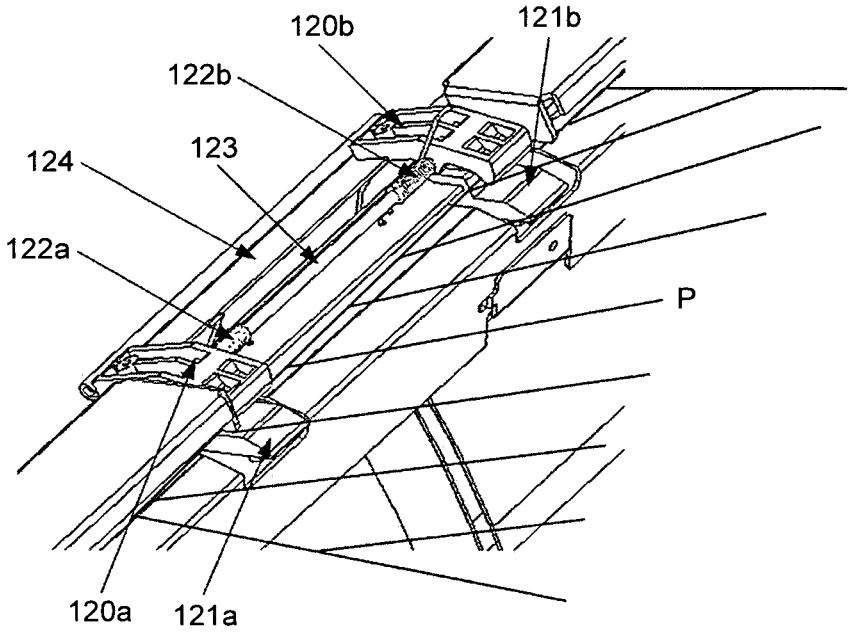
FIG. 5 is a view when

FIG. 4 is an enlarged view of dotted lined portion (R) illustrated in FIGS. 2 and 3 and illustrates a clamp unit clamping and holding the trailing edge of the sheet or sheet bundle. FIG. 5 is a view when FIG. 4 is viewed from a different angle and illustrates a state where the trailing edge of the sheet or sheet bundle P is clamped and held.

In the clamp unit of the clamp bundle conveying unit, the upper clamps 120*a* and 120*b* and the lower clamps 121*a* and 121*b* are connected to the clamp shaft 123, and the upper clamps 120*a* and 120*b* are connected using a clamp unit connecting metal plate 124. Therefore, the upper clamps 120*a* and 120*b* of the clamp unit on right and left can be simultaneously moved. The lower clamps 121*a* and 121*b* and the upper clamps 120*a* and 120*b* are biased by the spring force of the springs 122*a* and 122*b* so as to clamp and hold the trailing edge of the sheet or the sheet bundle P.

Figure 6:
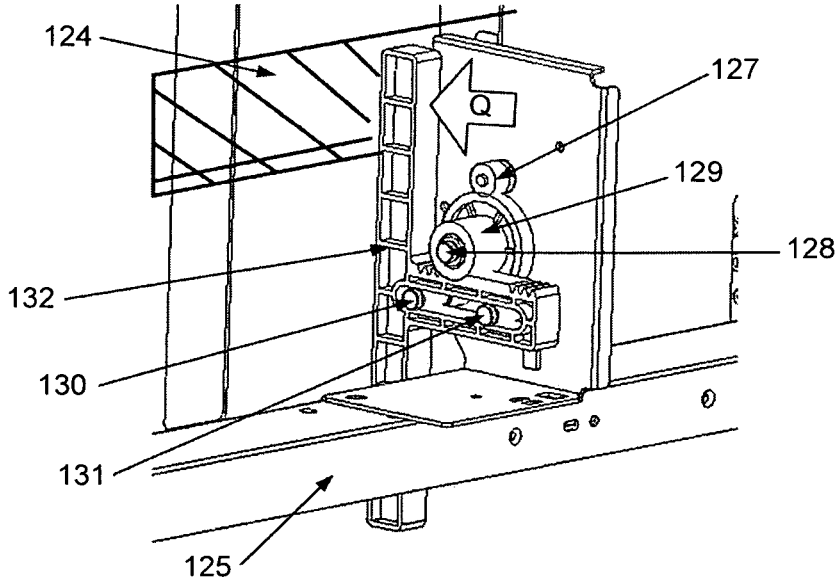
FIG. 6 is an enlarged view of dotted lined part (V) illustrated in FIG. 2.
Figure 7:
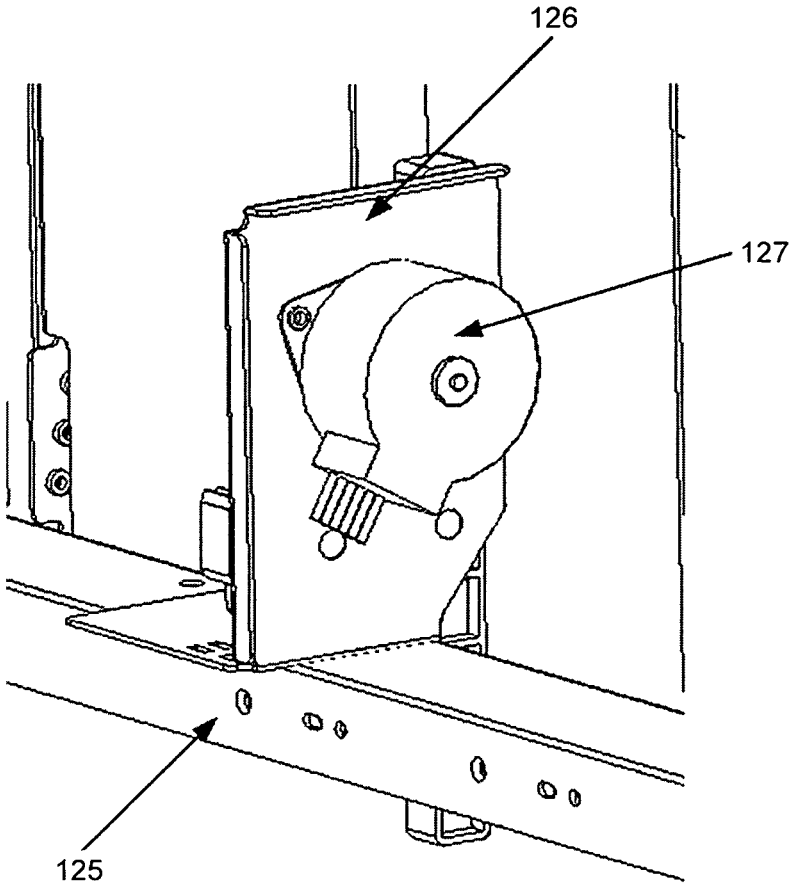
FIG. 7 is an enlarged view of the dotted lined part (V) illustrated in FIG. 2.

FIGS. 6 and 7 are enlarged views of dotted lined portion (V) illustrated in FIG. 2. FIG. 6 illustrates a clamp releasing mechanism releasing clamp by action of the springs 122*a* and 122*b* of the clamp unit that clamps and holds the trailing edge of the sheet or the sheet bundle. The clamp releasing mechanism is installed in a stay 125 and is driven by a clamp releasing motor 127 installed in a clamp releasing motor bracket 126. The power from the clamp releasing motor 127 is transmitted to a rack portion of a clamp pressure releasing lever 132 having shafts 130 and 131 as shafts in a transverse direction via a gear wheel 129 having a shaft 128 as a rotational shaft.

When the clamp pressure releasing lever 132 moves in an arrow Q direction to press the clamp unit connecting metal plate 124 that is illustrated in FIGS. 4 and 5, the upper clamps 120*a* and 120*b*, which are movable, are opened from the sheet or sheet bundle to release the sheet or sheet bundle. As a result of this, at a folding process after the sheet or sheet bundle is conveyed, the clamp is released so that a state capable of performing press folding is established.

Figure 8:
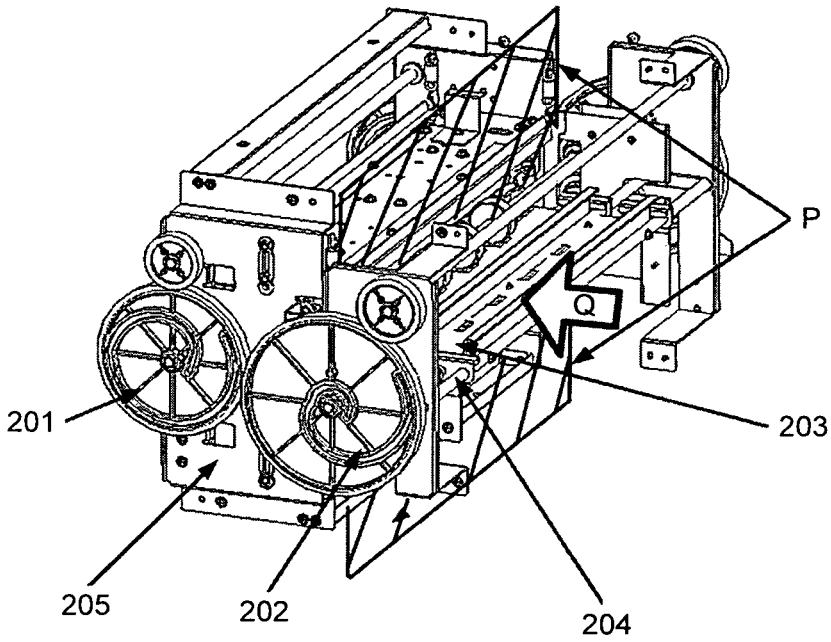
FIG. 8 is a perspective view of a press folding unit.
Figure 9:
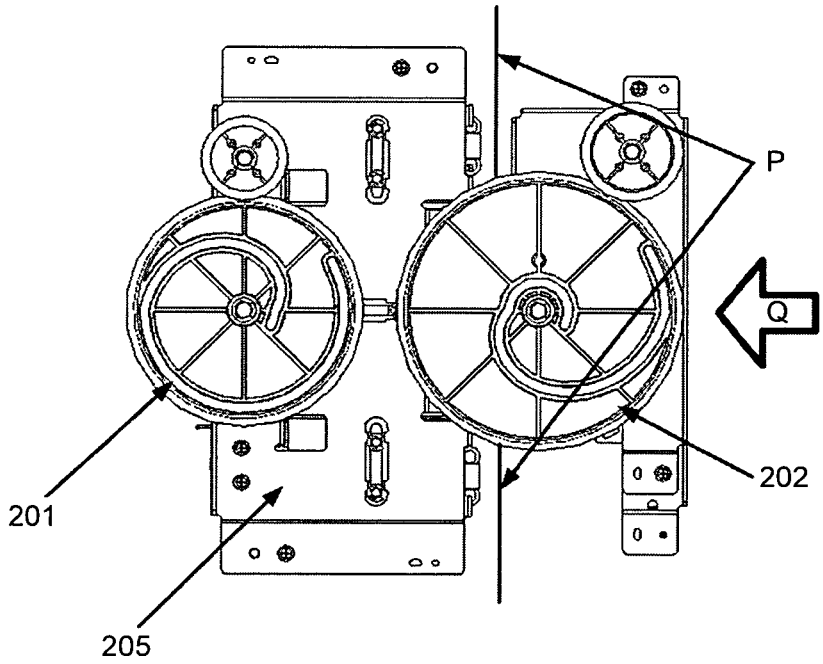
FIG. 9 is a side view of the press folding unit illustrated in FIG. 8.

The press folding unit will be described. FIG. 8 is a perspective view of the press folding unit and FIG. 9 is a side view of the press folding unit. The press folding unit includes a pressing plate driving cam 201, a folding blade driving cam 202, the folding blade 203, a folding blade supporting bar 204, and a side plate 205. The folding blade driving cam 202 is rotated to horizontally move the folding blade supporting bar 204 along a cam groove of the folding blade driving cam 202, thereby moving the folding blade 203 in an arrow Q direction to guide the central portion of the sheet or sheet bundle P in the sheet length to the folding unit.

Figure 10:
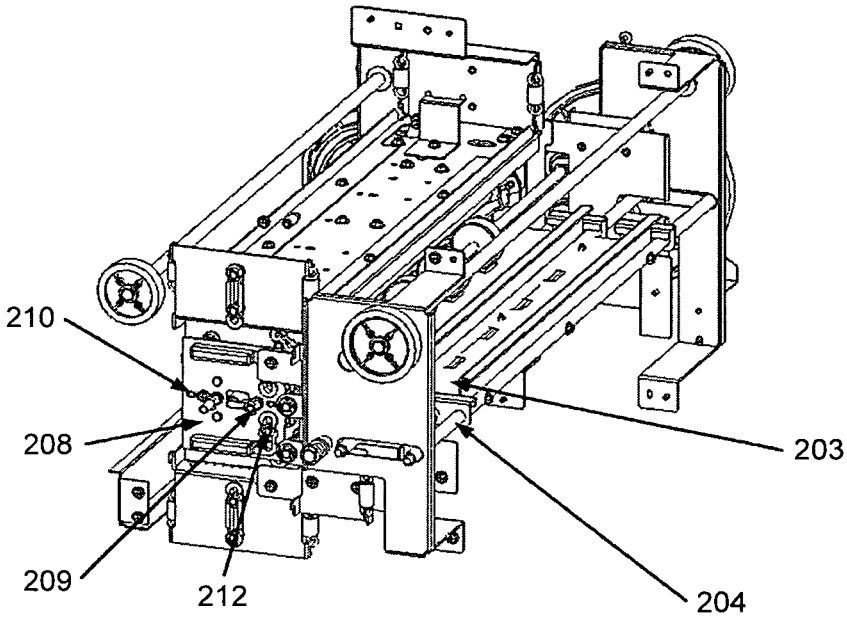
FIG. 10 is a view illustrating a state where a side plate, etc. are removed from FIG. 8.
Figure 11:
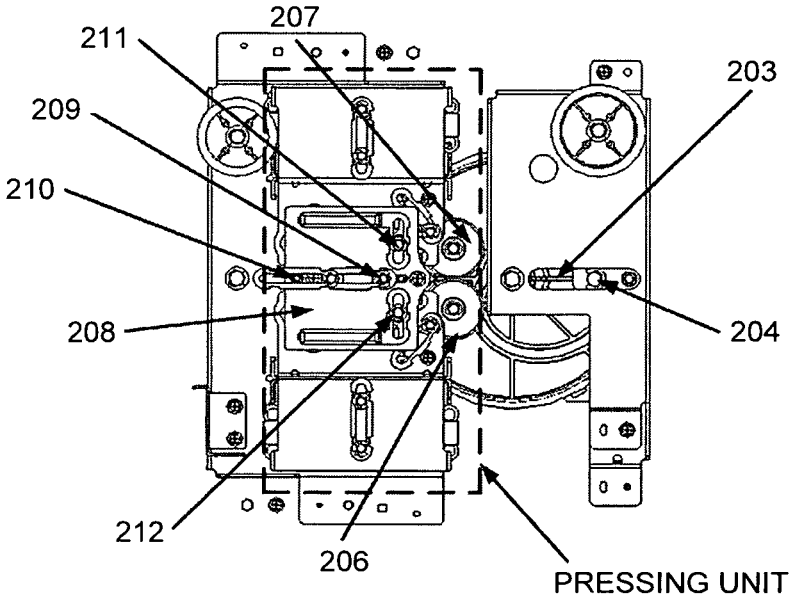
FIG. 11 is a view when

FIG. 10 is a schematic illustrating a state where the side plate 205 and other components are removed from FIG. 8, and FIG. 11 is a view when FIG. 10 is viewed from a side. A pressing unit that folds the sheet or sheet bundle P, which has been guided to the folding unit by the folding blade 203, is described with reference to FIGS. 10 and 11.

The pressing unit includes the conveying rollers 206 and 207, a movable plate 208, pressing guide rollers 211 and 212, and pressing pressure releasing cams 209 and 210. The folded leading edge of the sheet or sheet bundle P guided to the folding unit by the folding blade 203 is conveyed to the pressing unit by the conveying rollers 206 and 207. The movable plate 208 is moved to cause right and left movement of the pressing guide rollers 211 and 212 and the pressing pressure releasing cams 209 and 210 connected with the movable plate 208.

Figure 12:
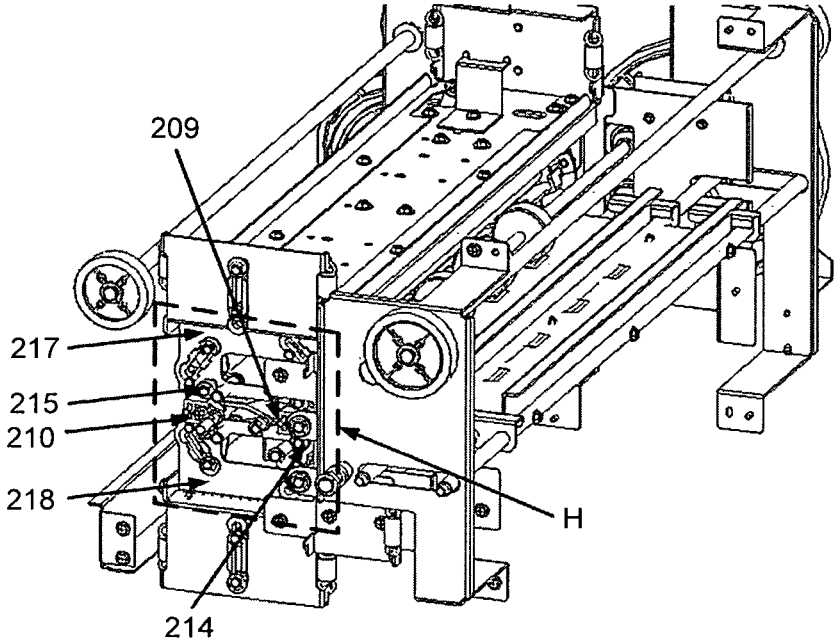
FIG. 12 is a view illustrating a state where a movable plate is removed from FIG. 10.
Figure 13:
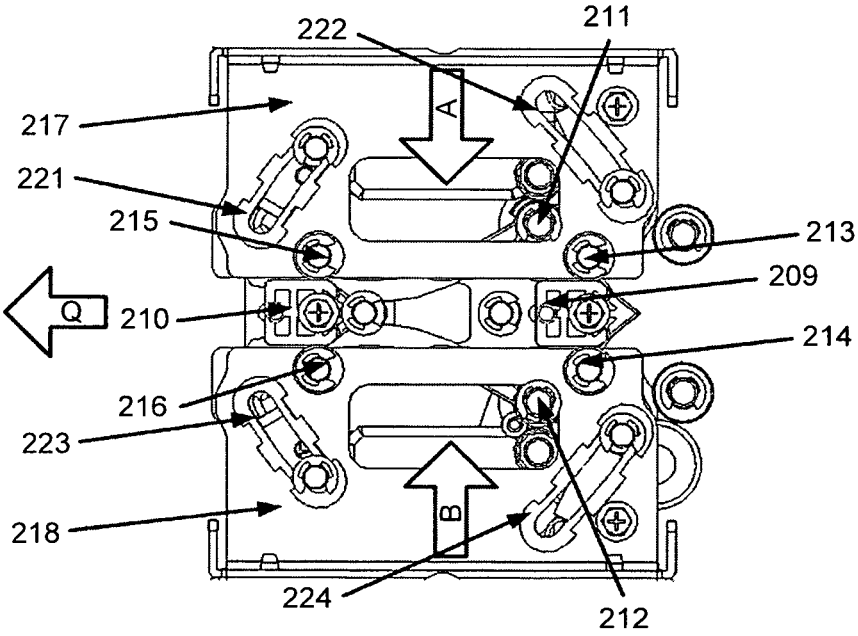
FIG. 13 is an enlarged side view of dotted lined part H illustrated in FIG. 12.

FIG. 12 is a schematic illustrating a state where the movable plate 208 is removed from FIG. 10, and FIG. 13 is an enlarged side view of the dotted lined portion (H) illustrated in FIG. 12. An upper pressing unit 217 and a lower pressing unit 218 are in a state of being pressurized toward each other by springs at the four portions of the unit corners. In a standby state, the upper pressing unit 217 and the lower pressing unit 218 are separated by the pressing pressure releasing cams 209 and 210 provided inside the press movable plate 208, which is a state to receive the folded leading edge of the sheet bundle.

The movable plate 208 moves in the arrow Q direction to move the pressing pressure releasing cams 209 and 210 connected with the movable plate 208. Then, rollers 213 and 215 of the upper pressing unit 217 and rollers 214 and 216 of the lower pressing unit 218 move in directions of arrows A and B, respectively, due to the inclined surfaces of the pressing pressure releasing cams 209 and 210, to press the folded portion of the sheet bundle.

Figure 14:
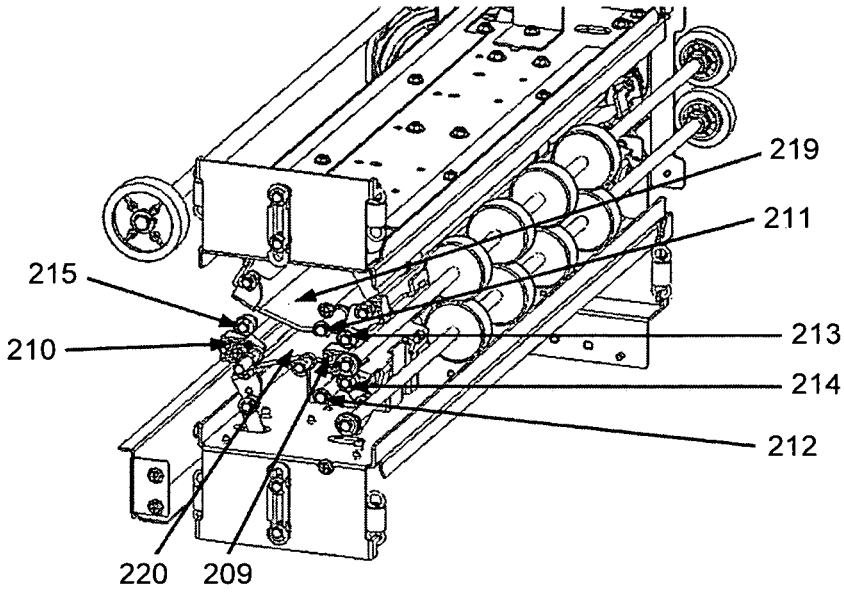
FIG. 14 is a view illustrating an internal structure of upper and lower pressing units illustrated in FIG. 11.
Figure 15:
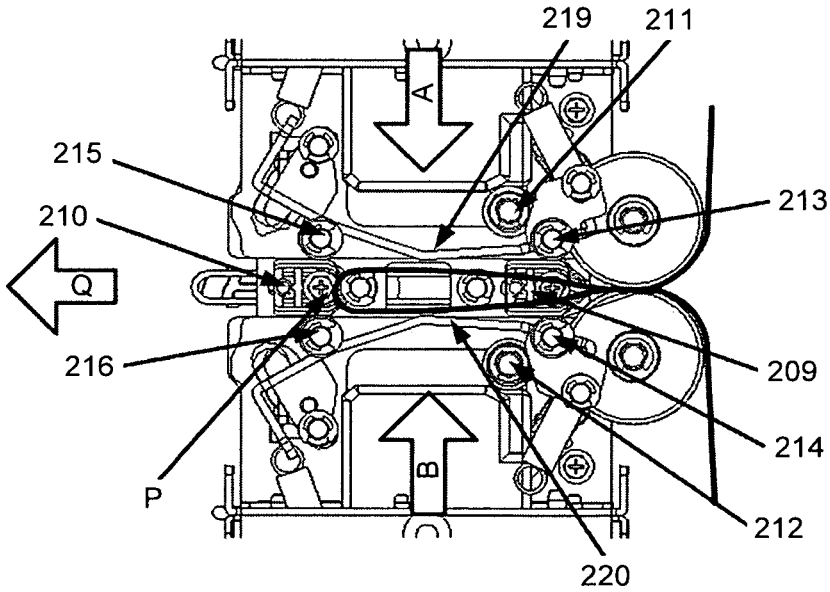
FIG. 15 is a side view corresponding to FIG. 14.

FIG. 14 is a schematic illustrating an internal structure of the upper and lower pressing units 217 and 218 illustrated in FIG. 11. FIG. 15 is a side view of FIG. 14. The pressing plates 219 and 220 are connected to an inside of the pressing unit. The pressing pressure releasing cams 209 and 210 move to move the pressing plate 219 in the arrow a direction and the pressing plate 220 in the arrow b direction in conjunction with the pressing unit. Thus, the sheet or sheet bundle P is nipped between the pressing plates 219 and 220 so that the sheet or sheet bundle P is folded. The pressing guide rollers 211 and 212 connected with the movable plate 208 move on the pressing plates 219 and 220 in conjunction with movement of the movable plate 208 in the arrow Q direction. In such a manner, folding is performed toward the folded leading edge of the sheet bundle P with curved shapes of the pressing plates 219 and 220 rotatable due to ditches (indicated by reference numerals 221, 222, 223, and 224 in FIG. 13) at the side surface of the pressing unit.

Figure 16:
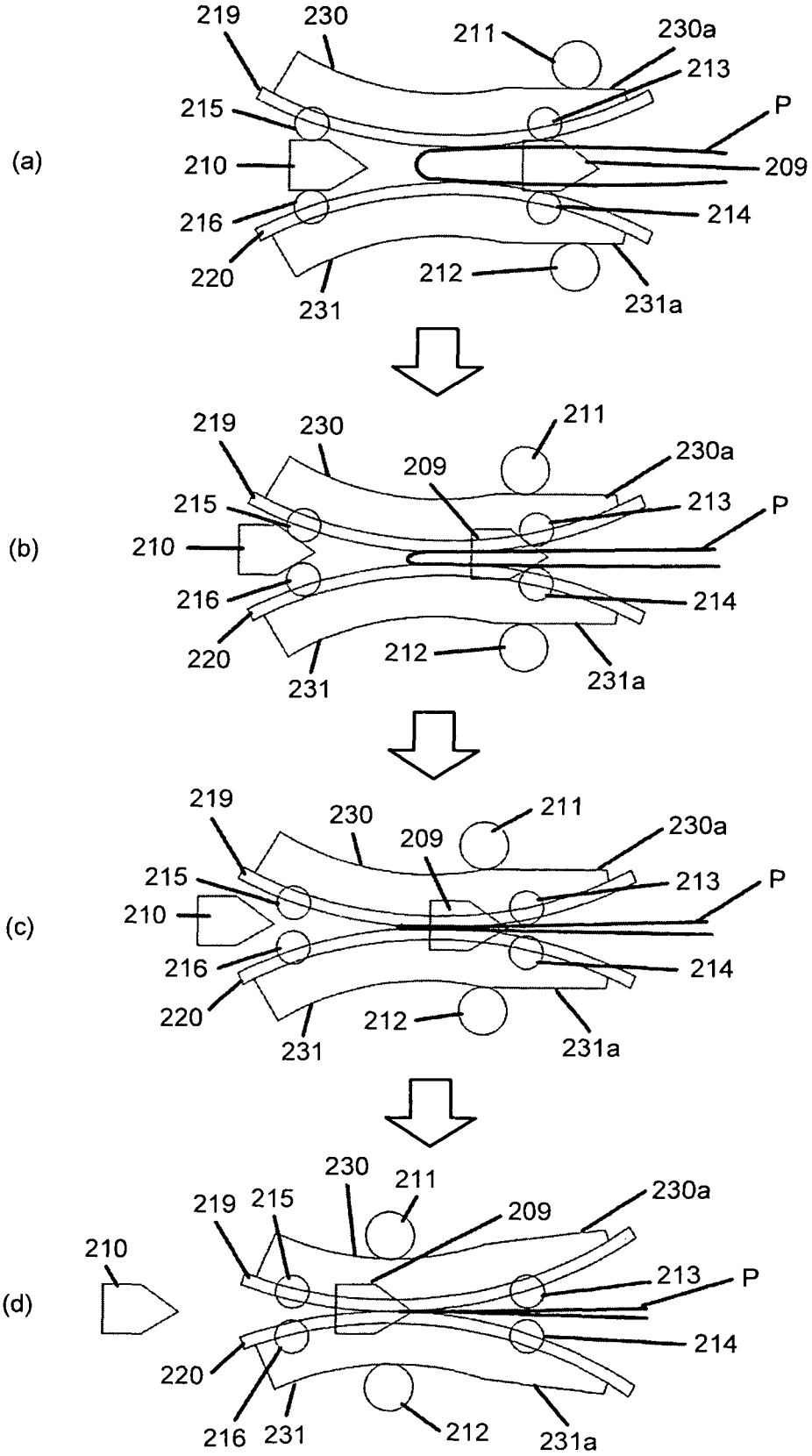
FIG. 16 is a view illustrating a flow of a pressing operation of folding a sheet bundle.

FIG. 16 illustrates a flow of a pressing operation to fold the sheet bundle. In a pressing standby state (state of FIG. 16(*a*)), the pressing pressure releasing cams 209 and 210 are inserted between the rollers 213 and 215 of the upper pressing unit 217 and the rollers 214 and 216 of the lower pressing unit 218. The pressing pressure releasing cams 209 and 210 and the pressing guide rollers 211 and 212 move in the left direction following the movement of the movable plate 208. The pressing pressure releasing cams 209 and 210 are off from the rollers 213 to 216 of the upper and lower pressing units 217 and 218, and thus, the upper and lower pressing units 217 and 218 come close to each other (state of FIG. 16(*b*)).

When the pressing pressure releasing cams 209 and 210 are completely off from the rollers 213 to 216, the pressing plates 219 and 220 are brought into contact with each other to apply pressing pressure onto the sheet bundle at a position between the pressing plates 219 and 220 in the vertical direction (state of FIG. 16(*c*)). Posture of the pressing plates 219 and 220 is not changed before the state of FIG. 16(*c*) because the pressing plates 219 and 220 are weighted by the pressing guide rollers 211 and 212 only in the vertical direction due to horizontal units 230*a* and 231*a* of guiding members 230 and 231 for the pressing plates 219 and 220. When the movable plate 208 is further moved, the pressing plates 219 and 220 are rolled by the pressing guide rollers 211 and 212 because shapes of the guiding members 230 and 231 of the pressing plates are the same as those of the pressing plates 219 and 220, respectively, so that the pressing plates 219 and 220 perform folding toward the folded leading edge of the sheet bundle (state of FIG. 16(*d*)).

Pressing pressure transmitting members and pressure moving members are described with reference to FIGS. 17 to 20.

Figure 17:
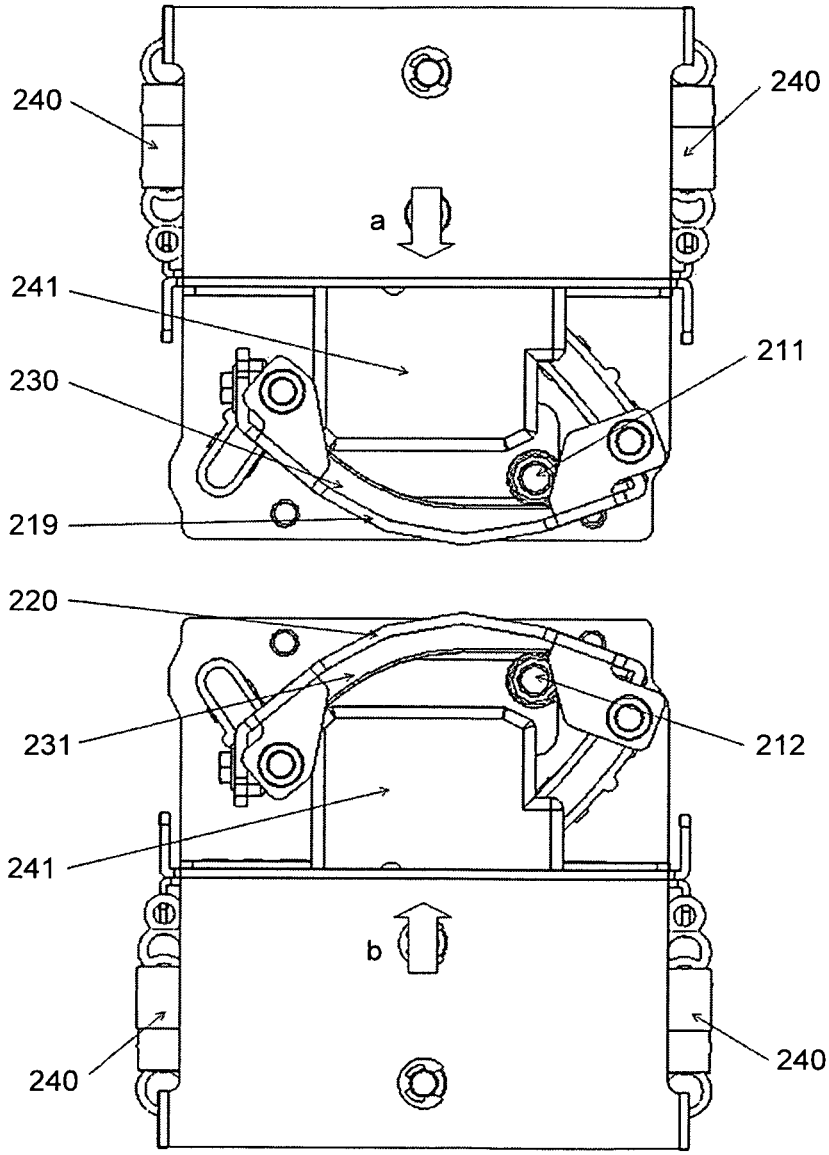
FIG. 17 is a schematic illustrating pressing pressure transmitting members and pressure moving members.

FIG. 17 is a cross-sectional view of the pressing unit described above. When springs 240 apply pressing pressure in arrows a and b directions of FIG. 17, pressure is transmitted from pressure transmitting members 241 to pressure moving members (pressing guide rollers: 211 and 212), is further transmitted to pressure transmitting members (guiding members: 230 and 231), and is finally transmitted to the pressing plates 219 and 220. The pressure moving members (pressing guide rollers: 211 and 212) move in a conveying direction, and therefore, the pressure transmitting members (241, guiding members: 230 and 231) can be made of, for example, polyoxymethylene (POM) members having slidability to allow improvement of the durability.

Figure 18:
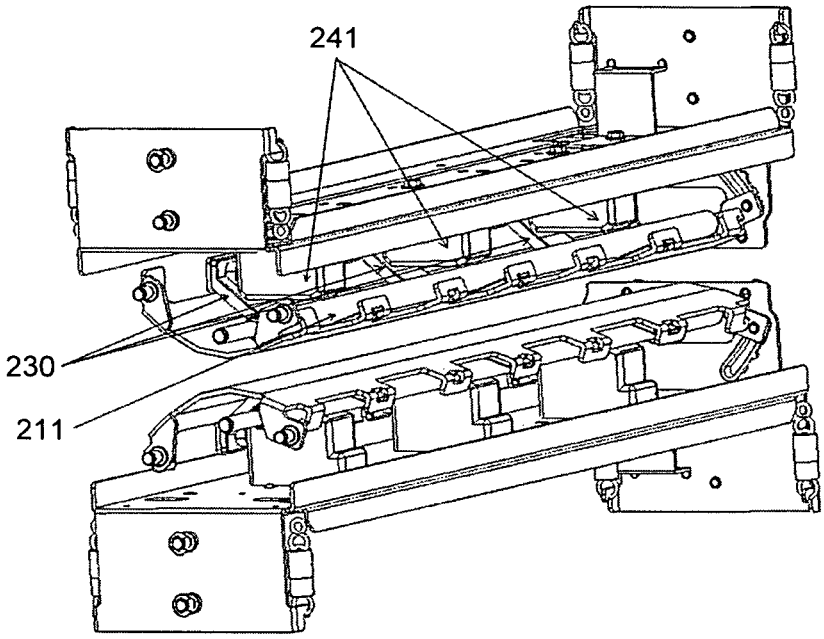
FIG. 18 is a schematic illustrating pressing pressure transmitting members and pressure moving members.

FIG. 18 is a perspective view of the pressing unit. A plurality of pressure transmitting members (241, guiding members: 230) are arranged in a direction orthogonal to the conveying direction. Arranging the plurality of pressure transmitting members can prevent occurrence of a part, which is not pressed, at a central portion of the sheet folding unit in width area (in a direction orthogonal to the conveying direction) to reliably enable reduction of the height of the folded portion.

Figure 19:
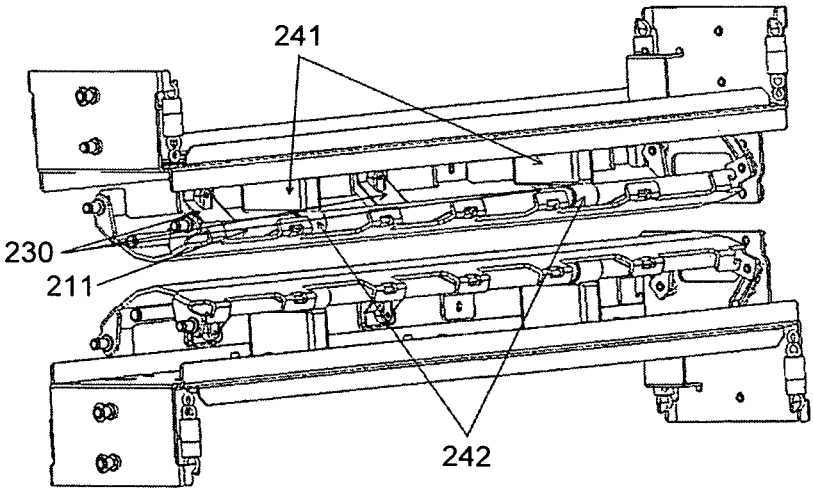
FIG. 19 is a schematic illustrating pressing pressure transmitting members and pressure moving members.

FIG. 19 is a perspective view of the pressing unit in which rotators are provided at the pressing pressure moving member. Rotators 242 are arranged at positions corresponding to the pressure transmitting members 241 of the pressure moving member (the pressing guide roller: 211). As a result of this, the pressure moving member (the pressing guide roller: 211) moves while rolling on the pressure transmitting members (the guiding members: 230), and the rotators 242 move while rolling on the pressure transmitting members 241, which enables improvement of durability.

Figure 20:
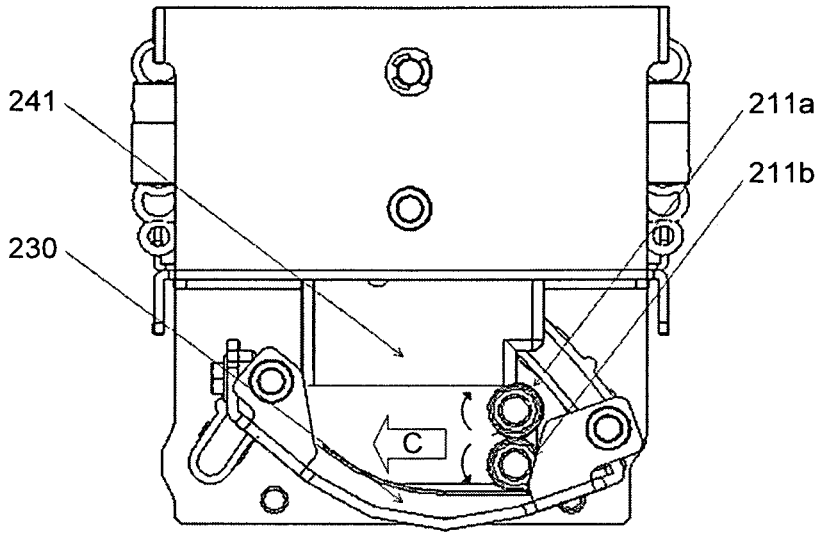
FIG. 20 is a schematic illustrating a pressing pressure transmitting member and pressure moving members.

FIG. 20 is a cross-sectional schematic of the pressing unit in which the pressing pressure moving members consist of a pair of rotators. Because the pressure moving members (the pressing guide rollers: 211*a* and 211*b*) consist of a pair of rotators, each of the rotators moves while rotating in an arrow direction when the pressure is moved in an arrow C direction of FIG. 20. Therefore, there is no sliding portion and thus durability can be further improved. By further providing bearing members at both ends of the pressure moving members (the pressing guide rollers: 211*a* and 211*b*), durability can also be improved in relation to sliding with the movable plate 208.

The sheet post-processing apparatus and the image forming apparatus of the present invention can reduce the height of the folded portion of a saddle stitched and center-folded sheet bundle and can improve qualities of saddle stitching and center-folding with a low-cost configuration without upsizing a machine.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet post-processing apparatus, comprising:

an accumulating unit accumulating a sheet having been conveyed;

a center-folding unit folding a central portion, in a conveying direction in which the sheet is conveyed, of the sheet, which has been accumulated by the accumulating unit, and a pressing force moving unit including a pair of opposed pressure plates and at least one pressure releasing cam, the pressure force moving unit configured to apply a pressing force to the sheet, which has been folded by the center-folding unit, and moves along a portion of the sheet, at which the pressing force is applied, on the sheet in the conveying direction.

2. The sheet post-processing apparatus according to claim 1, wherein the pressing force moving unit includes a plurality of pressing force moving units arranged in a direction orthogonal to the conveying direction of the sheet.

3. The sheet post-processing apparatus according to claim 2, wherein the at least one pressure releasing cam operationally contacts a surface of the plurality of pressing force moving units.

4. The sheet post-processing apparatus according to claim 1, wherein the pressing force moving unit further includes a movable plate having slidability and connected to the at least one pressure releasing cam.

5. The sheet post-processing apparatus according to claim 1, wherein the pressing force moving unit includes a rotator.

6. The sheet post-processing apparatus according to claim 3, wherein the rotator includes a pair of rotators.

7. The sheet post-processing apparatus according to claim 1, wherein the pressing force moving unit includes bearing members at both ends.

8. The sheet post-processing apparatus according to claim 1, wherein the center-folding unit has curved shape.

9. An image forming apparatus comprising the sheet post-processing apparatus according to claim 1.

10. The sheet post-processing apparatus according to claim 1, wherein the pressure plates are configured to be movable in a direction orthogonal to the conveying direction.

* * * * *